US006319186B1

(12) United States Patent
Pitkämäki

(10) Patent No.: US 6,319,186 B1
(45) Date of Patent: Nov. 20, 2001

(54) METHOD AND A DEVICE FOR CLEANING OF A CENTRIFUGAL SEPARATOR

(75) Inventor: Jouko Pitkämäki, Tumba (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/509,514

(22) PCT Filed: Aug. 17, 1999

(86) PCT No.: PCT/SE99/01382

§ 371 Date: Mar. 29, 2000

§ 102(e) Date: Mar. 29, 2000

(87) PCT Pub. No.: WO00/10715

PCT Pub. Date: Mar. 2, 2000

(30) Foreign Application Priority Data

Aug. 24, 1998 (SE) ..... 9802816
Sep. 8, 1998 (SE) ..... 9803035

(51) Int. Cl.[7] ..... B04B 15/06
(52) U.S. Cl. ..... 494/27; 494/37; 494/70
(58) Field of Search ..... 494/1–7, 10, 11, 494/23, 25–30, 37, 56, 68–70; 210/209, 210

(56) References Cited

U.S. PATENT DOCUMENTS 3,079,070 * 2/1963 Thylefors .
3,250,462 * 5/1966 Thylefors .
4,067,494 * 1/1978 Willus et al. .
4,278,200 * 7/1981 Gunnewig .
4,311,270 1/1982 Hovstadius .
4,729,759 * 3/1988 Krook et al. ..... 494/59
4,784,635 11/1988 Bruning et al. .
5,041,075 8/1991 Bruning et al. .
5,104,371 4/1992 Ajnefors .

FOREIGN PATENT DOCUMENTS

WO97/27946 8/1997 (WO) .

* cited by examiner

*Primary Examiner*—Charles E. Cooley
(74) *Attorney, Agent, or Firm*—Fish & Richardson P.C.

(57) ABSTRACT

In a particular type of centrifugal rotor for dividing a liquid mixture into one liquid phase having a low viscosity and one concentrate phase having a high viscosity, the concentrate phase on its way towards an outlet chamber (17) in the rotor has to flow through a vortex device (20). The vortex device has a property of admitting therethrough a larger flow of a liquid if this has a high viscosity than if it has a low viscosity. For making an operation for cleaning of the rotor and conduits for concentrate phase downstream of the rotor more efficient, a cleaning liquid, which has a low viscosity, is conducted not only through the vortex device (20) to said outlet chamber (17) for concentrate phase but to this outlet chamber (17) also through a separate passage (34). Thereby, it is guaranteed that a sufficient flow of cleaning liquid enters the concentrate outlet chamber (17) and from there can be pumped out of the rotor to the concentrate phase conduits downstream of the rotor.

11 Claims, 1 Drawing Sheet

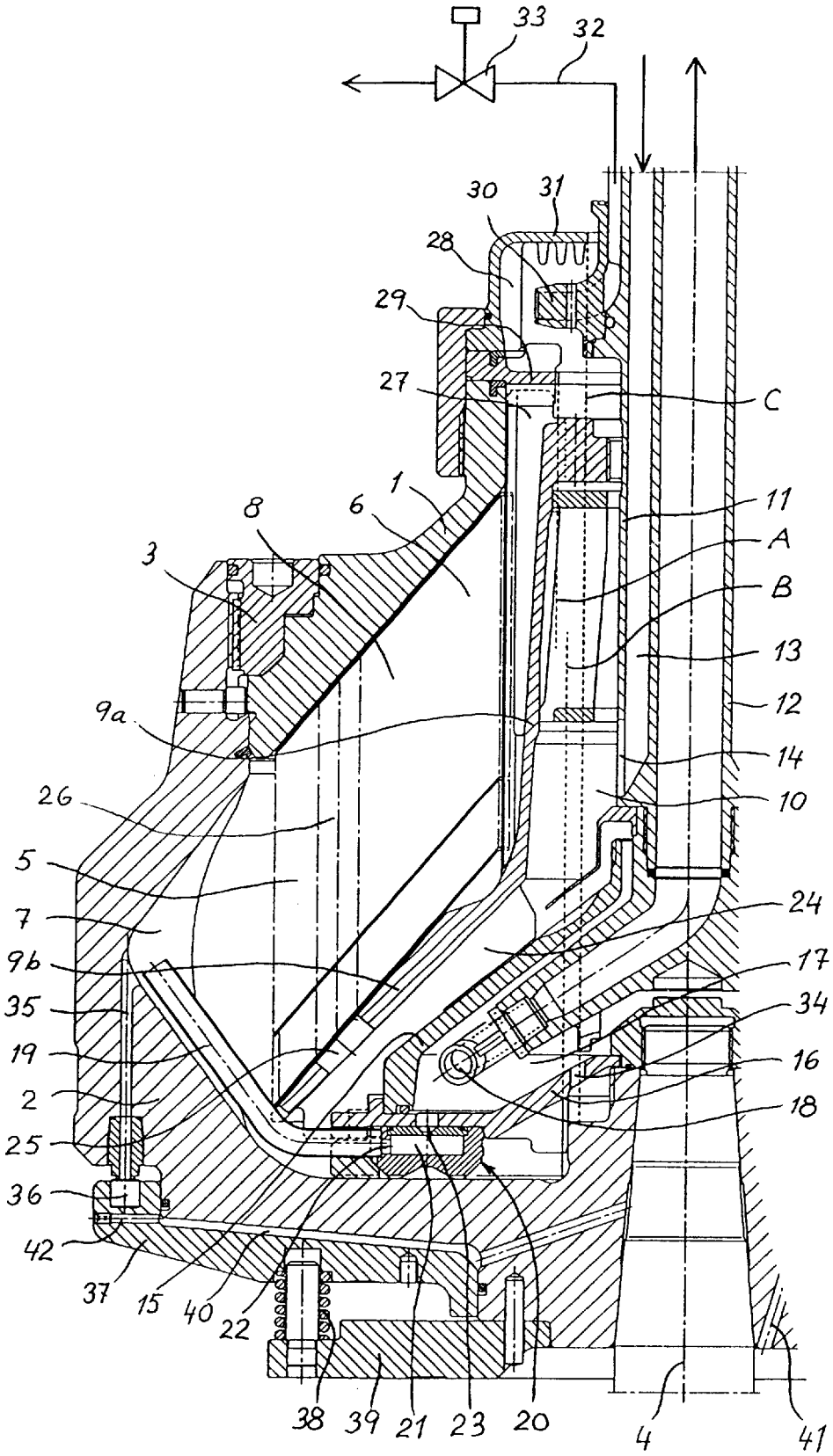
33
32
30
31
28
29
27
C
1
6
8
3
11
A
B
13
12
9a
14
10
26
5
7
24
9b
17
35
34
19
16
2
18
25
36
42
37
15
40
22
38
39
21
23
20
4
41

METHOD AND A DEVICE FOR CLEANING OF A CENTRIFUGAL SEPARATOR

BACKGROUND OF THE INVENTION

U.S. Pat. No. 4,311,270 describes a centrifugal separator intended for dividing a solids containing liquid mixture into one liquid phase, which is substantially free of solids and has a relatively low viscosity, and one concentrate phase, which is rich in solids and has a relatively high viscosity. The centrifugal separator comprises a rotor, which is rotatable around a central rotational axis and which has an inlet for said mixture, an outlet for said liquid phase and an outlet for said concentrate phase. Characteristic of the centrifugal separator according to U.S. Pat. No. 4,311,270 is that its rotor has in its outlet for the concentrate phase a vortex device, which has the property that it can maintain the viscosity substantially constant of the concentrate phase flowing therethrough and out of the rotor. Thus, if the viscosity of the outflowing concentrate phase tends to increase, the vortex device automatically lets out a larger flow of the concentrate phase, and if the viscosity tends to decrease, a smaller flow of the concentrate phase is let out of the rotor. Thereby, the vortex device can be formed in a way such that a desired viscosity is always obtained of the concentrate phase separated in and leaving the rotor.

One embodiment of the centrifugal separator according to U.S. Pat. No. 4,311,270, which has been used in practice, is the one shown in FIG. 3 of said U.S. Pat. No. 4,311,270. This is used for instance for separation of yeast. In a centrifugal separator of this kind the radially outermost part of the rotor separation chamber, the so-called concentrate space, where separated yeast is accumulated during operation of the rotor, constantly communicates with a central chamber in the rotor, the so-called concentrate chamber, from where the yeast is discharged out of the rotor through a so-called paring member. At least one so-called concentrate tube connects the concentrate space with the concentrate chamber and at the radially innermost part of the concentrate tube a vortex device of the previously described kind is placed, so that the yeast may pass therethrough before entering the concentrate chamber.

A problem which has been noticed in connection with a centrifugal separator of this kind is that parts of the rotor and certain process conduits outside the rotor downstream thereof have not been sufficiently clean upon a conventionally performed cleaning of the centrifugal separator during rotation of the rotor. During a cleaning of this kind cleaning liquid is continuously supplied through the rotor inlet for mixture to be treated within the rotor, the cleaning liquid being discharged from the rotor through the ordinary rotor outlets for separated liquid phase and separated concentrate phase, respectively. The problem having been noticed is concerned with the flow paths for separated concentrate phase, which have not been cleaned to a desired extent neither within the rotor nor downstream thereof.

The reason for the problem is that said vortex device has the property—which is desirable during normal separation but not in connection with cleaning of the centrifugal separator—that it reduces a through flow of liquid if the viscosity of the liquid decreases. Since cleaning liquid has a substantially lower viscosity than the concentrate phase normally passing through the vortex device, the resulting flow of cleaning liquid in the flow paths for the concentrate phase becomes undesirably low, which leads to an insufficient cleaning of these flow paths. It has been noticed in some cases that the flow of cleaning liquid through the relevant flow paths has only been about 30% of the normal flow of concentrate phase during separation.

The problem here concerned does not arise, of course, only in connection with the embodiment of a centrifugal separator as discussed above. In any centrifugal separator, the rotor of which has a vortex device of one kind or another placed in the flow path for a liquid concentrate phase between a so-called concentrate space and a so-called concentrate chamber, the problem will arise, thus, also for instance in a rotor provided with a vortex device of the kind which can be seen from DE 36 13 335 C1 or DE 36 35 059 C1.

SUMMARY OF THE INVENTION

The object of the present invention is to resolve the problem of insufficient cleaning of a centrifugal separator intended for division of a liquid mixture containing solids into one liquid phase, which is substantially free of solids and has a relatively low viscosity, and one concentrate phase, which is rich in solids and has a relatively high viscosity and a larger density than the liquid phase, which centrifugal separator comprises a rotor, which is rotatable around a central rotational axis and has an inlet for said mixture, an outlet for said liquid phase and an outlet for said concentrate phase, and in which centrifugal separator

- the rotor delimits a process liquid space comprising at least one separation chamber, which has a liquid space for separated liquid phase and a concentrate space for separated concentrate phase, a liquid outlet chamber, which communicates with said liquid space, and a concentrate outlet chamber, which through at least one concentrate passage communicates with said concentrate space,
- said concentrate passage extends through a vortex device which is adapted upon unchanged pressure drop across the same to admit a larger through flow of concentrate phase having a relatively high viscosity than of concentrate phase having a relatively low viscosity, and
- a concentrate outlet member, which is adapted not to rotate together with the rotor, extends into the concentrate outlet chamber for discharge of separated concentrate phase from the rotor.

The object of the present invention can be achieved in that

- cleaning liquid is introduced into the rotor to a part of said process liquid space of the rotor other than said concentrate outlet chamber,
- the cleaning liquid is transferred from said other part of the process liquid space of the rotor to the concentrate outlet chamber a way other than through said vortex device, and
- the cleaning liquid is removed from the concentrate outlet chamber and is discharged out of the rotor through said concentrate outlet member.

In this way cleaning liquid in a sufficient amount per unit of time may be supplied to the concentrate outlet chamber and from there be pumped further out through the concentrate outlet member to the flow paths for the concentrate phase downstream of the centrifugal separator.

If desired, cleaning liquid may be introduced into the rotor by means of a particular supply member, but preferably the normal centrifugal separator inlet for mixture to be treated in the rotor is used for this purpose.

The cleaning liquid may be transferred to the concentrate outlet chamber from said other part of the process liquid space in the rotor in different ways. For instance, a paring member or the like, which is placed centrally in the rotor and is radially movable, may be used to be moved during a cleaning operation to contact with cleaning liquid having been introduced into said other part of the rotor process liquid space. An outlet from a paring member of this kind may be adapted to conduct cleaning liquid thus pared out into the concentrate outlet chamber. Alternatively, a paring member may be used for the transfer of cleaning liquid, which is placed within the rotor but which is not radially movable, the free liquid surface of the cleaning liquid in said other part of the rotor process liquid space instead being moved radially inwardly in the rotor to a level radially inside that at which process liquid is present during normal operation of the centrifugal separator, i.e. during a separating operation.

If the free liquid surface of cleaning liquid is moved radially inwardly in the way just mentioned, it is not sure that a paring member need to be used for the transfer of cleaning liquid to the concentrate outlet chamber. Instead, with advantage, a transferring passage may be formed in the rotor itself, adapted to conduct cleaning liquid directly into the concentrate outlet chamber from said other part of the rotor process liquid space, when cleaning liquid reaches radially inwardly to said transferring passage.

Preferably, the centrifugal separator includes a liquid outlet member, which is adapted not to rotate together with the rotor and which extends into the liquid outlet chamber for discharging of separated liquid phase out of the rotor, and means adapted during normal operation of the centrifugal separator to maintain process liquid, i.e. mixture, separated liquid phase and separated concentrate phase, at predetermined radial levels in said process liquid space.

Hereby, the invention may be used in a way such that an outflow of cleaning liquid through said liquid outlet member is prevented or provided in a way such that said other part of the rotor process liquid space will contain cleaning liquid also radially inside the predetermined level, at which process liquid is present therein during normal operation of the centrifugal separator, and that cleaning liquid, which is present in said other part of the rotor process liquid space radially inside said predetermined level, at which process liquid is present therein during normal operation of the centrifugal separator, is conducted into the concentrate outlet chamber a way other than through said vortex device, e.g. through a transferring passage in a stationary paring member or a transferring passage formed in the rotor itself.

Said outlet members for separated liquid phase and separated concentrate phase may be of different kinds. Preferably, they are non-rotatable, even if they theoretically could be adapted to discharge liquid phase and concentrate phase, respectively, out of the rotor if they would rotate at a speed differing from the rotational speed of the rotor.

In a particular case they may be non-rotatable but radially adjustable, i.e. movable towards and/or away from the rotational axis of the rotor. Hereby, the free liquid surfaces in the liquid outlet chamber and the concentrate outlet chamber, respectively, may be adjusted to a desired radial level by means of the outlet members. Thus, according to one embodiment of the invention, the outlet member in the liquid outlet chamber may be situated at a first radial level during a separating operation but be moved closer to the rotational axis of the rotor when the centrifugal separator is to be cleaned, so that a free liquid surface of cleaning liquid will be obtained in the liquid outlet chamber radially inside the radial level, at which separated liquid phase was present therein during the separating operation.

If desired, an outlet member of the kind shown in WO 97/27946 may be used in one or both of the outlet chambers. An outlet member of this kind can be allowed to float on the free liquid surface in an outlet chamber. If then the outflow of liquid through the outlet member is throttled, so that liquid is accumulated in the rotor and the free liquid surface therein moves closer to the rotational axis of the rotor, the outlet member will automatically follow the free liquid surface radially inwardly.

For use of the invention it is sufficient, however, to utilize conventional stationary outlet members and, in connection with cleaning of the centrifugal separator, to hinder or throttle the outflow of cleaning liquid through the outlet member in the outlet chamber for separated liquid phase.

The invention also concerns a device for cleaning of a centrifugal separator of the kind discussed above. A device of this kind according to the invention is characterized in that a transferring member delimits at least one separate transferring or cleaning liquid passage, which connects the concentrate outlet chamber with the separation chamber through a different way than through the liquid outlet chamber and which extends at least partly at a level radially inside that at which process liquid is present, so that no flow process liquid will occur through the cleaning liquid passage during normal operation of the centrifugal separator, and that the rotor has limiting walls, which are formed in a way such that when said other part of the rotor process liquid space is charged with cleaning liquid, this other part is admitted to contain cleaning liquid also radially inside the level at which process liquid is present therein during normal operation of the centrifugal separator, so that a flow of cleaning liquid is allowed to come up through the cleaning liquid passage into the concentrate outlet chamber.

Said transferring member may be stationary and be supported within the rotor either by a stationary inlet pipe, through which mixture is introduced into the rotor during normal separation, or by either of the outlet members for discharge of the separated liquid phase and the separated concentrate phase, respectively. The transferring member would then operate in the same way as a stationary outlet member and be adapted to move cleaning liquid out of a first space in the rotor, e.g. the outlet chamber for separated liquid phase, into a second space in the rotor, i.e. the outlet chamber for separated concentrate phase.

However, the transferring member is preferably connected with or constitutes part of the rotor, so that it is rotatable together therewith. In this case, the cleaning liquid passage may be formed by one or more holes through a partition in the rotor, which separates the concentrate outlet chamber from some other part of the rotor process liquid space.

The invention is described in more detail below with reference to the accompanying drawing.

The drawing shows in an axial section one half of a rotor included in a centrifugal separator. The rotor has an upper part 1 and a lower part 2, which parts are connected with each other by means of a lock ring 3. The rotor is rotatable around a central rotational axis 4.

DETAILED DESCRIPTION

Within the rotor there is delimited an annular separation chamber 5, which has a centrally situated liquid phase space 6 and a peripherally situated concentrate space 7. A stack of frusto-conical separation discs 8 is arranged in the separation chamber 5.

Centrally in the rotor there is arranged a so-called distributor, which consists of a distributor neck 9*a* and a distributor foot 9*b*. The distributor neck 9*a* delimits an inlet chamber 10 for receiving a liquid mixture to be treated in the rotor. From above extends into the rotor and into the inlet chamber 10 a stationary inlet pipe 11 for said mixture. Through the inlet pipe 11 extends an outlet pipe 12, which shall be described in more detail later. Within the inlet pipe 11 there is formed around the outlet pipe 12 an inlet channel 13, which opens into the inlet chamber 10 through an opening 14.

Between the distributor foot 9*b* and the lowermost portion of the rotor part 2 are arranged coaxially with each other and with the rotor a frustoconical upper partition 15 and an also frusto-conical lower partition 16. Axially between the partitions 15 and 16 there is delimited an annular concentrate outlet chamber 17, which is open radially inwardly towards the rotational axis of the rotor. The previously mentioned outlet pipe 12 extends from the area of the rotational axis of the rotor radially outwardly and into the concentrate outlet chamber 17. In the radially outer part of the concentrate outlet chamber the outlet pipe 12 forms a so-called paring member having an opening 18, which communicates with the interior of the outlet pipe and which in the concentrate outlet chamber is facing in a direction opposite to the rotational direction of the rotor.

Each one of several concentrate pipes 19, which are distributed around the rotational axis of the rotor, extends from the peripherally situated concentrate space 7 of the separation chamber radially inwardly and opens into a vortex device 20. Thus, there are as many vortex devices 20 as there are concentrate pipes 19, distributed around the rotational axis of the rotor. Each vortex device 20 delimits a circular, cylindrical chamber 21, the geometric axis of which extends parallel to the rotational axis of the rotor. The chamber 21 has an inlet 22, which is directed tangentially in the chamber 21 and to which the concentrate pipe 19 is connected. The chamber 21, which is axially delimited by two end walls, further has a central outlet 23 in the form of an opening in one of these end walls, which outlet 23 together with an opening in the partition 16 forms a connection between the chamber 21 and the concentrate outlet chamber 17. The interior of a concentrate pipe 19 and the interior of the vortex device connected thereto, thus, form a concentrate passage connecting the concentrate space 7 with the concentrate chamber 17.

Between the distributor foot 9*b* and said upper partition 15 there is formed an inlet passage 24 for mixture to be treated in the separation chamber 5. The inlet passage 24 communicates at its radially inner part with the inlet chamber 10 and at its radially outer part between the concentrate pipes 19 with the separation chamber 5. The inlet passage 24 communicates with the separation chamber 5 also through several holes 25 in the distributor foot 9*b*, distributed around the rotational axis 4 of the rotor and situated axially opposite to respective similar so-called distribution holes 26 in the separation discs 8.

The liquid phase space 6 situated centrally in the separation chamber communicates through a passage 27 with a liquid outlet chamber 28. Between the passage 27 and the outlet chamber 28 there is arranged an annular member 29, the radially inner edge of which forms during operation of the rotor an overflow outlet for separated liquid phase flowing from the passage 27 into the outlet chamber 28.

A stationary liquid outlet member 30 extends from above into the rotor and radially outwardly into the liquid outlet chamber 28 to a level radially outside the level of the overflow outlet, which is formed by the inner edge of the member 29. In the outlet chamber 28 the outlet member 30 may have the form of a so-called paring disc, which at its periphery has several inlet openings distributed around the rotational axis of the rotor.

The liquid outlet chamber 28 is delimited upwardly towards the outside of the rotor by an annular member 31, the radially inner edge of which is situated radially inside the overflow outlet formed by the inner edge of the member 29. The member 31 thereby makes it possible that a free liquid surface can be maintained in the outlet chamber 28, when the rotor rotates, radially inside said overflow outlet between the passage 27 and the outlet chamber 28. This can be obtained by throttling or closure of the liquid outlet through the stationary outlet member 30. In the drawing there is shown schematically a conduit 32, which is connected to the outlet member 30, and a valve 33 arranged in this conduit, by means of which valve a flow through the conduit may be throttled or completely stopped.

In the lower part of the rotor the separation chamber 5 extends radially inwardly, between the concentrate pipes 19 and the vortex devices 20 all the way to a space axially below the aforementioned lower partition 16. Through the radially inner part of the partition 16 extends a passage 34, which connects the separation chamber 5 with the concentrate outlet chamber 17. The passage 34, which can be formed by one or more openings, is intended for through flow of cleaning liquid in connection with cleaning of the centrifugal separator while the rotor is rotating. Cleaning of this kind is to be described later.

At the radially outermost part of the separation chamber the rotor has a further outlet in the form of a number of outlet channels 35 extending axially through the lower rotor part 2 and distributed around the rotational axis of the rotor. Each outlet channel 35 is covered at its end on the outside of the rotor part 2 by means of a closing member 36, and an axially movable annular closing slide 37 supports such closing members 36 opposite to the respective outlet channels 35. The slide 37 is kept in its position, where the outlet channels 35 are closed by the closing members 36, by means of springs 38 which are supported by a plate 39, which is fastened to the rotor part 2. Between the slide 37 and the rotor part 2 there is formed a so-called opening chamber 40, which through a channel 41 may be charged with liquid of pressurized air for moving the slide 37 to a position in which the outlet channels are uncovered. The opening chamber 40 at its periphery has at least one heavily throttled drainage opening 42.

The drawing shows three vertical dotted lines A, B and C representing three radial levels in the rotor. During normal operation of the centrifugal separator, i.e. during a separating operation, a free liquid surface is present in the liquid passage 27 at the level A, i.e. at the radial level of the overflow outlet formed by the annular member 29. In the part of the separation chamber 51 which is situated axially below the partition 16 radially inside the vortex devices 20, there is situated during a separating operation a free liquid surface at the radial level B. During a cleaning operation there may be situated a free liquid surface in the outlet chamber 28 as well as in the part of the separation chamber 5, which is situated at the partition 16, at the radial level C, if no or only a small amount of liquid is conducted out of the outlet chamber 28 through the stationary outlet member 30.

The above described centrifugal separator operates in the following manner during a separating operation, in which a liquid mixture containing solids is divided into one liquid phase, which is substantially free of solids and has a relatively low viscosity, and one concentrate phase, which is rich in solids and has a relatively high viscosity. The solids have a density which is larger than that of the liquid in which they are suspended.

Liquid to be treated in the rotor after it has been brought into rotation is conducted into the rotor through the inlet channel 13 and flows through the opening 14 into the inlet chamber 10. From there the mixture flows further through the inlet passage 24 and the holes 25 into the separation chamber 5. The mixture is distributed between the separation discs 8 by flowing axially through the distribution holes 26 therein.

Between the separation discs 8 the components of the mixture are actuated by the centrifugal force, the solids moving away from the rotational axis 4 of the rotor and being accumulated in the concentrate space 7, whereas liquid freed from particles moves towards the rotational axis to the liquid phase space 6.

The liquid phase flows further through the liquid passage 27 and across the overflow outlet at the member 29 to the outlet chamber 28. Through the stationary outlet member 30 liquid is pumped out of the outlet chamber 28 and further through the conduit 32 outside the rotor. The outlet member 30 has a capacity such that it can safely discharge all separated liquid phase entering the outlet chamber 28 and maintain a free liquid surface therein, which is situated radially outside the overflow outlet formed by the annular member 29.

As a consequence hereof a free liquid surface will be maintained in the liquid passage 27 by the just mentioned overflow outlet at the previously mentioned radial level A.

Like the liquid passage 27 also the space in the rotor situated axially below the lower partition 16 communicates with the separation chamber 5. In this space below the partition 16 there will also be formed a free liquid surface, but this will be maintained at the previously mentioned radial level B, i.e. somewhat closer to the rotational axis of the rotor than the liquid surface at the level A. The reason for this is that, during the separating operation, liquid will all the time flow radially inwardly in the interspaces between the separation discs 8 and a flow resistance comes up for this flow. There will be no corresponding flow resistance on the way between the radially outer part of the separation chamber 5 and said space below the partition 16, since no liquid flow comes up this way during the separation.

The particles accumulated in the concentrate phase space 7 form together with a small amount of liquid a concentrate phase having a relatively large viscosity, which flows through the concentrate pipes 19 to and into the vortex devices 20.

Concentrate phase enters tangentially each chamber 21 of a respective vortex device, in which a heavy rotation comes up around the center axis of the chamber 21. The concentrate phase is forced during its rotation towards the center of the chamber 21 and leaves it through the outlet 23 and enters the concentrate outlet chamber 17.

Concentrate phase having entered the outlet chamber 17 from the different vortex devices is conducted out of the outlet chamber 17 by means of the stationary concentrate outlet member 12. The concentrate phase forms a free liquid surface in the outlet chamber 17 at a radial level which is determined by the flow resistance for the concentrate phase in the outlet member 12 and in the conduit (not shown) to which the outlet member is connected outside the rotor. Normally, there is maintained a counter pressure for the outflow of the concentrate phase through the outlet member 12 such that the free liquid surface in the outlet chamber 17 will be maintained only a small distance radially inside the inlet opening 18 in the outlet member 17. So that a sufficiently large flow of concentrate may come up through the concentrate pipes 19 and the vortex devices 20 the liquid surface in the outlet chamber 17 is maintained at a substantial distance radially outside the levels A and B.

As to the function of the vortex devices 20, reference is made to the detailed explanation hereof in U.S. Pat. No. 4,311,270. Only the main function of the vortex devices is to be mentioned briefly here.

The size of the flow of a liquid that can be accomplished through a vortex device of the kind here described depends on the pressure drop, which is accomplished across the vortex device, and on the viscosity of said liquid. Within certain limits, which may be determined for each relevant vortex device, the vortex device at a certain pressure drop across it will admit therethrough a larger flow of a liquid having a relatively large viscosity than of a liquid having a relatively low viscosity. This means that if the viscosity of the liquid increases somewhat, the through flow of liquid increases. When the viscosity of the liquid then decreases, also the flow through the vortex device decreases. The vortex device as used in the centrifugal separator here described thereby constitutes a self-regulating means, by which automatically a desired viscosity may be maintained during a separating operation of the concentrate phase, which is separated in the separation chamber of the rotor and which leaves the rotor after having passed through the vortex device.

After a finished separating operation the centrifugal separator may be cleaned in the following way.

After the supply of mixture to the rotor has been interrupted, the peripheral outlet channels 35 of the rotor are opened by axial movement of the slide 37, so that the whole rotor content is thrown out through these outlet channels. After this the outlet channels 35 are closed again and cleaning liquid is introduced into the rotor through the inlet channel 13 in the inlet pipe 11. The cleaning liquid enters the separation chamber 5 through the inlet chamber 10 and the inlet passage 24. Part of the cleaning liquid flows through the concentrate pipes 19 and the vortex devices 20 into the concentrate outlet chamber 17, and another part flows through the outlet passage 27 to the outlet chamber 28. Cleaning liquid is pumped out of the rotor from the outlet chambers 17 and 28 through the stationary outlet members 12 and 30, respectively. At this stage of the cleaning operation free liquid surfaces of cleaning liquid are formed at the level A in the outlet passage 27 and at the level B in the part of the separation chamber situated axially below the partition 16. Free liquid surfaces in the outlet chambers 17 and 28 are formed substantially at the same levels as during a normal separating operation. However, the flow of cleaning liquid into the concentrate outlet chamber 17 is substantially smaller than the flow of separated concentrate phase during a normal separating operation. The reason for this is that the viscosity of the cleaning liquid is substantially lower than that of the separated concentrate phase and that, therefore, the vortex devices admit therethrough only a very limited flow of cleaning liquid. As to the function of the vortex devices reference is made to the previously made description thereof. The consequence of this is that the concentrate outlet chamber 17 and the flow paths for concentrate phase downstream thereof, i.e. the outlet pipe 12 as well as the conduits and possible further process equipment downstream of the rotor, will become relatively ineffectively cleaned. In contrast thereto, however, the outlet member 30 and the flow paths for separated liquid phase will become very effectively cleaned, since the most part of supplied cleaning liquid will leave the rotor through the outlet member 30.

After the outlet member 30 and the outlet conduit 32 have been cleaned by means of the flow of cleaning liquid therethrough, this flow is throttled by means of the valve 33. Upon need, the valve 33 is closed entirely. Hereby, the free liquid surface in the outlet chamber 28 will move radially inwardly and in the outlet chamber 28 as well as in the outlet passage 27 the free liquid surface will move to the level C. Closer than this to the rotational axis 4 of the rotor the liquid surface in the outlet chamber 28 cannot move, since after this cleaning liquid will leave the rotor through the radially inner edge of the member 31.

When the outflow of cleaning liquid through the outlet conduit 32 is throttled or interrupted, the free surface of cleaning liquid in the part of the separation chamber that is situated axially below the partition 16 also moves radially inwardly from the level B to the level C. Thereby, cleaning liquid will flow into the concentrate outlet chamber 17 also through the passage 34. This means that now the whole amount of supplied cleaning liquid, if desired, is supplied to the concentrate outlet chamber 17 and can be pumped out through the outlet pipe 12 and further through conduits and process equipment downstream of the rotor. Thus, an effective cleaning can hereby be accomplished of such conduits and process equipment.

Also the rotor will be effectively cleaned internally by the described cleaning operation. Firstly, contributing to this is the movement of the liquid surface occurring in the outlet chamber 28 and the outlet passage 27, when the outflow of cleaning liquid is throttled or interrupted by means of the valve 33. Also a large part of the outside of the outlet member 30 will be cleaned hereby. Secondly, contributing to the cleaning of the rotor internally will be the inflow of cleaning liquid into the concentrate chamber 17 through the passage 34. Hereby, namely, cleaning liquid will splash effectively in the outlet chamber and thereby clean the walls thereof.

If desired, the outflow of cleaning liquid through the outlet member 12 may be occasionally throttled, e.g. by means of a valve similar to the valve 33, so that the outlet chamber is filled for a short period of time with cleaning liquid. Hereby, even a large part of the outside of the outlet member in the outlet chamber will be effectively cleaned.

It can be noticed that an inflow of cleaning liquid into the concentrate outlet chamber 17 through the passage 34 does not necessarily require that the passage 34 is situated at a level radially outside the level of the radially inner edge of the member 31, which upwardly delimits the outlet chamber 28. If, namely, a certain flow of cleaning liquid is maintained out of the rotor through the outlet member 30, it is possible by supply of a sufficient amount of cleaning liquid to the inlet chamber 10 to displace the free liquid surface in the space below the partition 16 radially inside the radial level of said inner edge of the member 31. The reason for this is that a liquid flow radially inwardly in the interspaces between the separation discs 8 meets a flow resistance which is larger than that coming up for a flow from the inlet chamber 10 through the inlet passage 24 to and through the space below the partition 16.

It has been described above how the concentrate outlet chamber 17 can be charged with cleaning liquid through an extra passage 34 from the rotor separation chamber. This is only one of several possible embodiments of the present invention. A corresponding passage may, instead, be arranged between the concentrate outlet chamber and some other part of the process liquid space of the rotor. For instance, a passage or channel of this kind may instead be arranged between the concentrate outlet chamber and the inlet chamber 10 or the outlet chamber 28 for separated liquid phase.

It is further possible within the scope of the invention to accomplish a passage for cleaning liquid by means of a stationary liquid transferring member, which is supported within the rotor for instance by means of the concentrate outlet member 12 or the inlet pipe 11 or the liquid phase outlet member 30. A passage forming stationary liquid transferring member of this kind is suitably adapted to be situated radially inside a free liquid surface formed in the rotor during a normal separating operation, e.g. in the inlet chamber 10, but to be situated at a radial level such that it will be immersed in cleaning liquid when such cleaning liquid is supplied to the rotor and the free liquid surface is moved radially inwardly, as described above in connection with movement of the liquid surface in the outlet passage 27 from the level A to the level C. The liquid transferring member in this way, like an outlet member, similar to the outlet members 12 and 30, may conduct cleaning liquid from the relevant rotating liquid body in the rotor to the concentrate outlet chamber and deliver it therein.

What is claimed is:

1. A method of cleaning a centrifugal separator intended for a process of separating a liquid mixture containing solid particles into one liquid phase, which is substantially free from solid particles and has a relatively low viscosity, and one concentrate phase, which is rich in solid particles and has a relatively high viscosity and a larger density than the liquid phase, which centrifugal separator includes a rotor (1, 2), which is rotatable around a central rotational axis (4) and which has an inlet (13) for said mixture, an outlet (32) for said liquid phase and an outlet (12) for said concentrate phase, and in which centrifugal separator the rotor delimits a process liquid space including at least one separation chamber (5), which has a liquid space (6) for separated liquid phase and a concentrate space (7) for separated concentrate phase, a liquid outlet chamber (28), which communicates with said liquid space, and a concentrate outlet chamber (17), which through at least one concentrate passage (19, 21, 23) communicates with said concentrate space (7), said concentrate passage (19, 21, 23) extends through a vortex device (20) which is adapted at an unchanged pressure drop across itself to admit a larger through flow of concentrate phase having a relatively high viscosity than of concentrate phase having a relatively low viscosity, and a concentrate outlet member (12), which is adapted not to rotate together with the rotor (1, 2), extends into the concentrate outlet chamber (17) for discharge of separated concentrate phase out of the rotor, wherein cleaning liquid is introduced into the rotor to a part of the process liquid space of the rotor other than said concentrate outlet chamber (17), cleaning liquid is transferred from said other part of the rotor process liquid space to the concentrate outlet chamber (17) a way other than through said vortex device (20) and cleaning liquid is removed from the concentrate outlet chamber (17) and is conducted out of the rotor through said concentrate outlet member (12).

2. A method according to claim 1 of cleaning a centrifugal separator, which also includes a liquid outlet member (30), which is adapted not to rotate together with the rotor (1, 2) and which extends into the liquid outlet chamber (28) for discharge of separated liquid phase out of the rotor, and means adapted during normal operation of the centrifugal separator to maintain process liquid, at predetermined radial levels (A, B) in said process liquid space, wherein an outflow of liquid through said liquid outlet member (30) is prevented or controlled in a manner such that said other part of the process liquid space of the rotor will contain cleaning liquid also radially inside one of the predetermined radial levels (A, B), at which process liquid is present therein during normal operation of the centrifugal separator, and cleaning liquid, which is present in said other part of the rotor process liquid space radially inside one of the predetermined radial levels (A, B), at which process liquid is present therein during normal operation of the centrifugal separator, is conducted into the concentrate outlet chamber (17) a way (34) other than through said vortex device (20).

3. A method according to claim 2, in which an outflow of liquid through said liquid outlet member (30) is impeded to a degree such that said other part of the rotor process liquid space will contain cleaning liquid also radially inside one of the predetermined radial levels (A, B), at which process liquid is present therein during normal operation of the centrifugal separator.

4. A device for cleaning of a centrifugal separator intended for a process of dividing a liquid mixture containing solid particles into a liquid phase, which is substantially free of solid particles and has a relatively low viscosity, and a concentrate phase, which is rich in solid particles and has a relatively high viscosity, which centrifugal separator comprises a rotor (1, 2), which is rotatable around a central rotational axis (4) and which has an inlet (11) for said mixture, an outlet (32) for said liquid phase and an outlet (12) for said concentrate phase, and in which centrifugal separator the rotor delimits a process liquid space including at least one separation chamber (5), which has a liquid space (6) for separated liquid phase and a concentrate space (7) for separated concentrate phase, a liquid outlet chamber (28), which communicates with said liquid space (16), and a concentrate outlet chamber (17), which through several concentrate passages (19, 21, 23) distributed around the rotational axis (4) of the rotor communicates with said concentrate space (7), each of said concentrate passages (19, 21, 23) extends through a vortex device (20), which is adapted at an unchanged pressure drop across itself to admit a larger through flow of concentrate phase having a relatively high viscosity than of concentrate phase having a relatively low viscosity, several vortex devices (20) are distributed around the rotational axis (4) of the rotor, each concentrate passage (19, 21, 23) opening tangentially into a vortex device, a liquid outlet member (30), which is adapted not to rotate together with the rotor (1, 2), extends into the liquid outlet chamber (28) for discharge of separated liquid phase,.

a concentrate outlet member (12), which is adapted not to rotate together with the rotor (1, 2), extends into the concentrate outlet chamber (17) for discharge of separated concentrate phase, and means are arranged during normal operation of the centrifugal separator to maintain process liquid, at predetermined radial levels in said process liquid space, wherein a transferring member (16) delimits at least one separate cleaning liquid passage (34), which connects the concentrate outlet chamber (17) with the separation chamber through a different way than through the liquid outlet chamber (28) and which extends at least partly at a level (C) radially inside that at which process liquid is present, so that no flow of process liquid will occur through the cleaning liquid passage (34) during normal operation of the centrifugal separator, and the rotor has limiting walls (31), which are formed in a way such that when a part of the rotor process liquid space other than said concentrate outlet chamber (17) is charged with cleaning liquid this other part is admitted to contain cleaning liquid even radially inside one of said predetermined radial levels, at which process liquid is present therein during normal operation of the centrifugal separator, so that an outflow of cleaning liquid is allowed to come up through the cleaning liquid passage (34) into the concentrate outlet chamber (17).

5. A device according to claim 4, in which said transferring member (16) is connected with or is constituted by a part of the rotor (1, 2), so that it is rotatable therewith.

6. A device according to claim 4, in which said concentrate space (7) is situated in the radially outer part of the separation chamber (5) and a part of each concentrate passage is formed of a concentrate tube (19), which extends from the concentrate space (7) to an inlet of said vortex device (20), an outlet (23) of the vortex device communicating with said concentrate outlet chamber (17).

7. A device according to claim 6, in which the concentrate space (7) is situated at a level radially outside said liquid space (6) in the separation chamber and each concentrate tube (19) extends towards the rotational axis (4) of the rotor from the concentrate space (7).

8. A device according to claim 4, in which the concentrate outlet chamber (17) is delimited in the rotor radially inside the concentrate space (7) in the separation chamber, the separation chamber (5) has an inlet (24) for mixture that is present axially between the concentrate outlet chamber (17) and the liquid outlet chamber (28), and the cleaning liquid passage (34) communicates with the concentrate outlet chamber (17) on an axial side thereof which is faced away from the inlet (24) of the separation chamber for mixture.

9. A device according to claim 4, in which said liquid outlet member (30) forms an outlet channel (32), and a valve (33) is adapted for reduction of the liquid flow out through this outlet channel (32) when the centrifugal separator is to be cleaned, so that cleaning liquid being supplied to the rotor is forced to fill the process space in the rotor to a level (C) radially inside the levels at which process liquid is present during normal operation of the centrifugal separator.

10. A device according to claim 9, in which the liquid outlet member (30) is stationary.

11. A device according to claim 4, in which the concentrate outlet member (12) is stationary.

* * * * *